United States Patent [19]

Lutz et al.

[11] 4,439,508

[45] Mar. 27, 1984

[54] ELECTROPHOTOGRAPHIC RECORDING MATERIAL COMPRISES ARSENIC, SELENIUM AND TELLURIUM

[75] Inventors: Manfred Lutz; Bernd Reimer, both of Warstein, Fed. Rep. of Germany

[73] Assignee: Licentia Patent-Verwaltungs-GmbH, Frankfurt, Fed. Rep. of Germany

[21] Appl. No.: 269,943

[22] Filed: Jun. 3, 1981

[30] Foreign Application Priority Data

Jun. 3, 1980 [DE] Fed. Rep. of Germany ..... 3020940

[51] Int. Cl.[3] ..... G03G 5/08

[52] U.S. Cl. ..... 430/84; 430/944; 252/501.1

[58] Field of Search ..... 430/86, 944, 84, 95

[56] References Cited

U.S. PATENT DOCUMENTS 3,615,413 10/1971 Fisher et al. ..... 430/86
4,008,082 2/1977 Beschoner et al. ..... 96/1.5

FOREIGN PATENT DOCUMENTS 2248054 12/1974 Fed. Rep. of Germany .
2308070 9/1976 Fed. Rep. of Germany .
2856494 7/1979 Fed. Rep. of Germany ..... 430/86
1408207 10/1975 United Kingdom ..... 430/86

OTHER PUBLICATIONS

Chemical Abstracts, vol. 84, col. 52100m, (1976).
T. Ishiwata et al, "Near ir Sensitive Electrophotographic Receptor", J. Appl. Phys. 51(1), Jan. 1980, pp. 444–445.

*Primary Examiner*—John D. Welsh
*Attorney, Agent, or Firm*—Spencer & Frank

[57] ABSTRACT

An electrophotographic recording material including a photoconductor made of a selenium compound applied as a layer on an electrically conductive substrate. The photoconductor includes a compound of arsenic, selenium and tellurium of the formula $As_2Se_{3-x}Te_x$, where $0<x<3$.

5 Claims, 1 Drawing Figure

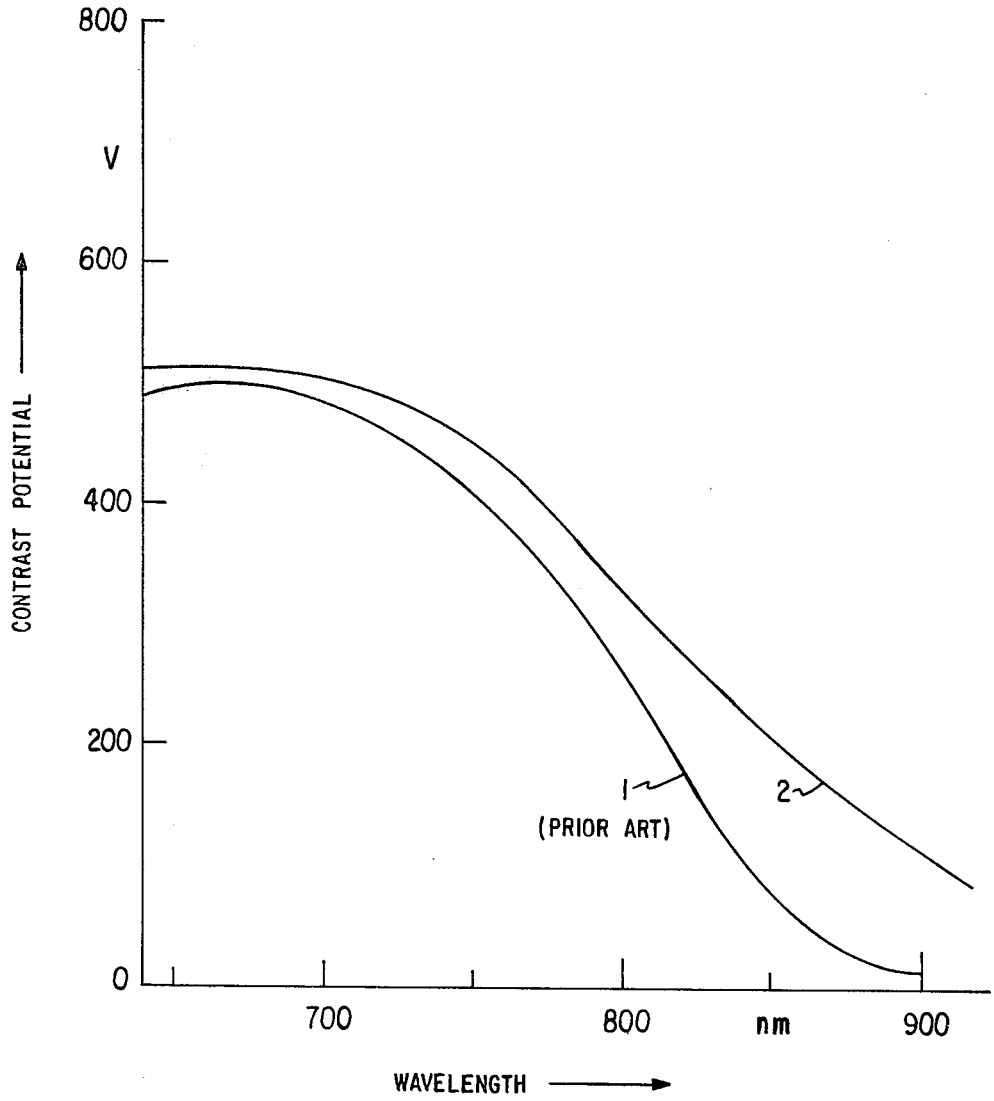
800
V
600
400
200
0
CONTRAST POTENTIAL
1
(PRIOR ART)
2
700
800
nm
900
WAVELENGTH

ELECTROPHOTOGRAPHIC RECORDING MATERIAL COMPRISES ARSENIC, SELENIUM AND TELLURIUM

BACKGROUND OF THE INVENTION

The present invention relates to an electrophotographic recording material including a photoconductor made of a selenium compound applied to an electrically conductive substrate.

Electrophotographic recording materials are used for electrophotographic copying processes which have found wide application in the photocopying art. Such processes are based on the property of photoconductive materials to change their electrical resistance when exposed to an activating radiation.

After a photoconductive layer has been electrically charged and exposed to activating radiation in a pattern corresponding to an optical image, a latent electric charge image, which corresponds to the optical image, is produced on the photoconductive layer. At the exposed locations, the conductivity of the photoconductive layer is increased to such an extent that the electric charge can flow off, at least in part, through the conductive substrate, but in any event, the flow off is greater at the exposed locations than at the unexposed locations. At the unexposed locations, the electric charge should remain essentially intact, and the pattern of the charge can then be made visible by means of an image powder, a so-called toner. The resulting toner image, if necessary, can then be transferred to paper or a similar record carrier.

Electrophotographically active substances which have been employed include organic and inorganic substances. Among the substances which have been used, selenium, selenium alloys and compounds with selenium have gained particular significance. They play an impotant role particularly in their amorphous state and have found many uses in practice.

The change in the electrical conductivity of a photoconductor depends on the intensity and the wave length of the radiation employed. Within the range of visible light which is preferred for practical use in electrophotography, for example, in office copiers, amorphous selenium exhibits high sensitivity on the blue side, i.e. in the short wave range, whereas on the red side, i.e. in the long wave range, it exhibits a very low sensitivity.

The result is that a red character is reproduced on an electrophotographic plate in the same manner as a black character, which under certain circumstances, particularly with colored masters, may present practical disadvantages, since a black character on a red background—or vice versa—will not be distinguishable from its background and cannot, therefore, be made visible. For wavelengths in the infrared range, amorphous selenium is not suitable at all.

In contradistinction to amorphous selenium, crystallized selenium is known to be red sensitive. Thus, the use of crystallized selenium makes possible reproduction involving this part of the visible spectrum. However, the high dark conductivity of crystallized selenium, i.e. its characteristic of being such a good conductor for electric current while in the unexposed state that a charge applied to its surface cannot be maintained for the length of time required for electrophotographic purposes, discourages its use for such electrophotograhic purposes.

Additions to selenium, such as arsenic or tellurium, are known to broaden the spectral sensitivty of selenium into the longer wave spectral range. However, systems comprised of selenium and tellurium alloys present disadvantages in that it is more difficult to prepare the photoconductive layer since such alloys are more difficult to evaporate homogeneously. Moreover, with a higher tellerium concentration, the electrophotographic layer exhibits an undesirable tendency toward crystallization and thus has only a short service life.

Moreover, no selenium based photoconductos are known which have a significant and practically usable sensitivity extending into a wavelength range of over 800 nm. Sensitivity in that range is desired behavior however, if electrophotography is also to be used to advantage for other purposes. For example, data output devices are available which operate with infra-red (IR) solid state lasers as radiation sources, in a wavelength range from about 800 to 850 nm. If such radiation is to be detected by a photoconductor, the photoconductor must be sensitive in such a wavelength range.

SUMMARY OF THE INVENTION

It is therefore an object of the present invention to provide an electrophotographic recording material which is as panchromatic as possible, and which has a photoconductor which is highly sensitive in both the visible light and infra-red spectral ranges, so that it can be used both in conventional office copiers and with data output devices that may be operated with solid state laser radiation.

It is a further object of the present invention to provide a photoconductor which constitutes a mechanically hard and thermally stable system, to assure a long service life.

To achieve these objects and in accordance with its purpose, the present invention provides an electrophotographic recording material including a photoconductor made of a selenium compound applied as a layer onto an electrically conductive substrate, in which the photoconductor includes a compound of arsenic, selenium and tellurium having the formula $As_2Se_{3-x}Te_x$.

In three component compounds of the formula $As_2Se_{3-x}Te_x$, it is of course necessary that $0<x<3$. Preferably, however, $0.05<x<2.5$ and most preferably $0.1<x<0.5$.

The thickness of the photoconductor layer should be 20 to 100 microns, preferably 50 to 70 microns. The electrically conductive substrate is preferably made of aluminum or a metallized plastic.

By utilizing the present invention, the electrophotographic recording material can be used to advantage not only in the prior art applications, but also in applications which require sensitivity in wavelength ranges over 800 nm, for example 810 nm to 850 nm, and up to about 950 nm. Thus electrophotography is opened to new applications.

It is to be understood that both the foregoing general description and the following detailed description are exemplary, but are not restrictive of the invention.

BRIEF DESCRIPTION OF THE DRAWINGS

The sole drawing FIGURE is a graph of contrast potential vs. wavelength for a prior art photoconductive layer and a photoconductive layer according to the present invention.

DESCRIPTION OF THE PREFERRED EMBODIMENTS

A photoconductor according to the present invention, for example, one having a composition of $As_2Se_{2.85}Te_{0.15}$, is twice as sensitive as $As_2Se_3$ at a wavelength of $\lambda=800$ nm. With a charging level of $V_0=+800$ V, the photoconductor having the above-mentioned composition produces a contrast potential of 400 V under a laser diode radiation of $\lambda=800$ nm at 1.5 $\mu J/cm^2$ (microjoules/cm) with a residual potential of 0 V.

The drawing FIGURE compares over a broad spectral range, the sensitivity, represented by a contrast potential, of a prior art photoconductive layer having the composition $As_2Se_3$ (curve 1) and a photoconductive layer of $As_2Se_{2.85}Te_{0.15}$ according to the present invention (curve 2). Both curves were made at a charging potential of about +600 V and an illumination intensity of about 3.5 $\mu J/cm^2$. As can be seen from the shape of the curves, the sensitivity of the material of the present invention is noticeably improved over the prior art photoconductor in the wavelength range about 750 nm, and is considerably improved in the wavelength range above 800 nm.

The electrophotographic recording material according to the invention may be produced by conventional methods. For example, the compound according to the present invention —for example $As_2Se_{2.85}Te_{0.15}$—can be evaporated in a high vacuum and applied in a layer thickness of about 60 microns to a substrate, such as an aluminum substrate, which has been cleansed by glow discharge and which serves as a conductive carrier. The temperature of the thermal evaporator should be about 380° C., while the temperature of the substrate is maintained at about 210°-220° C. After cooling, a highly sensitive panchromatic photoconductor is obtained. The photoconductive layer can also be produced according to other prior art methods.

The photoconductive layer of $As_2Se_{3-x}Te_x$ preferably is the sole photoconductive layer which is present in the electrophotographic recording material of the present invention and is preferably applied directly to the substrate. The electrophotographic recording material of the present invention preferably contains only the substrate and the photoconductive layer of $As_2Se_{3-x}Te_x$. It can prepared as a homogeneous photoconductive layer. Due to its high crystallization temperature of about 180° C., no tendency toward crystallization at room temperature exists and the service life is long.

It will be understood that the above description of the present invention is susceptible to various modifications, changes and adaptions, and the same are intended to be comprehended within the meaning and range of equivalents of the appended claims.

What is claimed is:

1. In an electrophotographic recording material comprising a photoconductor made of a selenium compound applied as a layer on an electrically conductive substrate, the improvement wherein the photoconductor comprises a compound of arsenic, selenium and tellurium of the formula $As_2Se_{3-x}Te_x$, where $0.05<x<0.5$, and said layer of said compound is the sole photoconductive layer in the electrophotographic recording material.

2. Electrophotographic recording material according to claim 1, wherein $0.1<x<0.5$.

3. Electrophotograhic recording material according to claim 1, or 2, wherein the said layer has a thickness of 20 to 100 microns.

4. Electrophotographic recording material according to claim 3, wherein said layer has a thickness of 50 to 70 microns.

5. Electrophotographic recording material according to claim 1, or 2, which is used for recording with solid state laser diode radiation in a spectral range up to about 950 nm.

* * * * *